US010758105B2

(12) United States Patent
Thiyagarajan

(10) Patent No.: US 10,758,105 B2
(45) Date of Patent: Sep. 1, 2020

(54) HEATING ASSEMBLY FOR A WASHING APPLIANCE

(71) Applicant: Haier US Appliance Solutions, Inc., Wilmington, DE (US)

(72) Inventor: Ramasamy Thiyagarajan, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 205 days.

(21) Appl. No.: 16/049,883

(22) Filed: Jul. 31, 2018

(65) Prior Publication Data

US 2020/0037845 A1 Feb. 6, 2020

(51) Int. Cl.

| | |
|---|---|
| ***A47L 15/00*** | (2006.01) |
| ***A47L 15/08*** | (2006.01) |
| ***A47L 15/42*** | (2006.01) |
| *A47L 15/48* | (2006.01) |

(52) U.S. Cl.

CPC ..... *A47L 15/0047* (2013.01); *A47L 15/08* (2013.01); *A47L 15/4221* (2013.01); *A47L 15/4285* (2013.01); *A47L 15/4291* (2013.01); *A47L 15/483* (2013.01); *A47L 2501/03* (2013.01); *A47L 2501/06* (2013.01)

(58) Field of Classification Search

CPC .. A47L 15/0047; A47L 15/08; A47L 15/4221; A47L 15/4285; A47L 15/4291; A47L 15/483; A47L 2501/03; A47L 2501/06

See application file for complete search history.

(56) References Cited

U.S. PATENT DOCUMENTS

| | | | | |
|---|---|---|---|---|
| 3,658,075 | A * | 4/1972 | Jacobs | A47L 15/483 134/107 |
| 8,603,260 | B2 | 12/2013 | Classen et al. | |
| 2007/0157954 | A1* | 7/2007 | Classen | A47L 15/481 134/56 D |
| 2012/0204911 | A1* | 8/2012 | Classen | A47L 15/483 134/105 |
| 2013/0333238 | A1* | 12/2013 | Thiyagarajan | F28D 15/0275 34/476 |
| 2014/0059880 | A1* | 3/2014 | Bertsch | A47L 15/0034 34/443 |
| 2019/0029492 | A1* | 1/2019 | Thiyagarajan | A47L 15/4293 |
| 2019/0046004 | A1* | 2/2019 | Thiyagarajan | A47L 15/46 |

(Continued)

FOREIGN PATENT DOCUMENTS

| | | |
|---|---|---|
| EP | 20130333238 | 4/2011 |

*Primary Examiner* — Sharidan Carrillo
(74) *Attorney, Agent, or Firm* — Dority & Manning, P.A.

(57) ABSTRACT

A dishwashing appliance includes a tub defining a wash chamber, a water storage chamber, an inlet defined in the tub and providing fluid communication into the wash chamber, and a heat pipe heat exchanger. The heat pipe heat exchanger includes a sealed casing, a working fluid contained within the sealed casing, a condenser section, and an evaporator section. The condenser section is in operative communication with the inlet upstream of the wet chamber. The dishwashing appliance also includes a fluid circulation system configured to deliver fluid to the wash chamber from the water storage chamber. The fluid circulation system includes a spray nozzle configured to spray wash fluid onto the evaporator section of the heat pipe heat exchanger.

7 Claims, 8 Drawing Sheets

(56) References Cited

U.S. PATENT DOCUMENTS

| | | | | |
|---|---|---|---|---|
| 2019/0059694 | A1* | 2/2019 | Hofmann | A47L 15/0047 |
| 2019/0059695 | A1* | 2/2019 | Hofmann | A47L 15/507 |
| 2019/0133412 | A1* | 5/2019 | Hofmann | A47L 15/507 |
| 2019/0208982 | A1* | 7/2019 | Thiyagarajan | F28D 21/0012 |
| 2019/0216289 | A1* | 7/2019 | Vallejo | B01D 53/265 |
| 2020/0029784 | A1* | 1/2020 | Thiyagarajan | A47L 15/483 |
| 2020/0037845 | A1* | 2/2020 | Thiyagarajan | A47L 15/4285 |

* cited by examiner

HEATING ASSEMBLY FOR A WASHING APPLIANCE

FIELD OF THE INVENTION

The present subject matter relates generally to washing appliances, such as dishwashing appliances and, more particularly, to a heating assembly of a washing appliance.

BACKGROUND OF THE INVENTION

Dishwashing appliances generally include a tub that defines a wash chamber. Rack assemblies can be mounted within the wash chamber for receipt of articles for washing where, e.g., detergent, water, and heat, can be applied to remove food or other materials from dishes and other articles being washed. Various cycles may be included as part of the overall cleaning process. For example, a typical, user-selected cleaning option may include a wash cycle and rinse cycle (referred to collectively as a wet cycle), as well as a drying cycle. In addition, spray-arm assemblies within the wash chamber may be used to apply or direct fluid towards the articles disposed within the rack assemblies in order to clean such articles.

Fluids used in the cleaning process may be heated. For example, hot water may be supplied to the dishwasher and/or the dishwasher may include one or more heat sources for heating fluids used in wash or rinse cycle and for providing heat during a drying cycle. It is common to provide dishwashers with rod-type, resistive heating elements in order to supply heat within the wash chamber during one or more of the dishwasher cycles. Generally, these heating elements include an electric resistance-type wire that is encased in a ceramic-filled, metallic sheath. The usage of such electric heaters typically leads to increased energy consumption. Moreover, a significant portion of the energy used to heat the water, e.g., for the wash cycle, may be wasted when the hot water is discharged from the dishwasher after being applied to the articles.

Accordingly, an improved heating device for a dishwashing appliance that provides for improved energy usage would be welcomed in the technology.

BRIEF DESCRIPTION OF THE INVENTION

Aspects and advantages of the technology will be set forth in part in the following description, or may be obvious from the description, or may be learned through practice of the technology.

In one embodiment a dishwashing appliance is provided. The dishwashing appliance includes a tub defining a wash chamber, a water storage chamber, an inlet defined in the tub and providing fluid communication into the wash chamber and a heat pipe heat exchanger. The heat pipe heat exchanger includes a sealed casing, a working fluid contained within the sealed casing, a condenser section, and an evaporator section. The condenser section is in operative communication with the inlet upstream of the wash chamber. The dishwashing appliance also includes a fluid circulation system configured to deliver fluid to the wash chamber from the water storage chamber. The fluid circulation system includes a spray nozzle configured to spray wash fluid onto the evaporator section of the heat pipe heat exchanger.

In another embodiment, a method of operating a dishwashing appliance is provided. The method includes pumping wash fluid from a storage chamber of the dishwashing appliance to a spray nozzle and spraying the pumped wash fluid from the spray nozzle onto an evaporator section of a heat pipe heat exchanger. The method also includes flowing ambient air across a condenser section of the heat pipe heat exchanger and into a wash chamber of the dishwashing appliance from the condenser section of the heat pipe heat exchanger.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
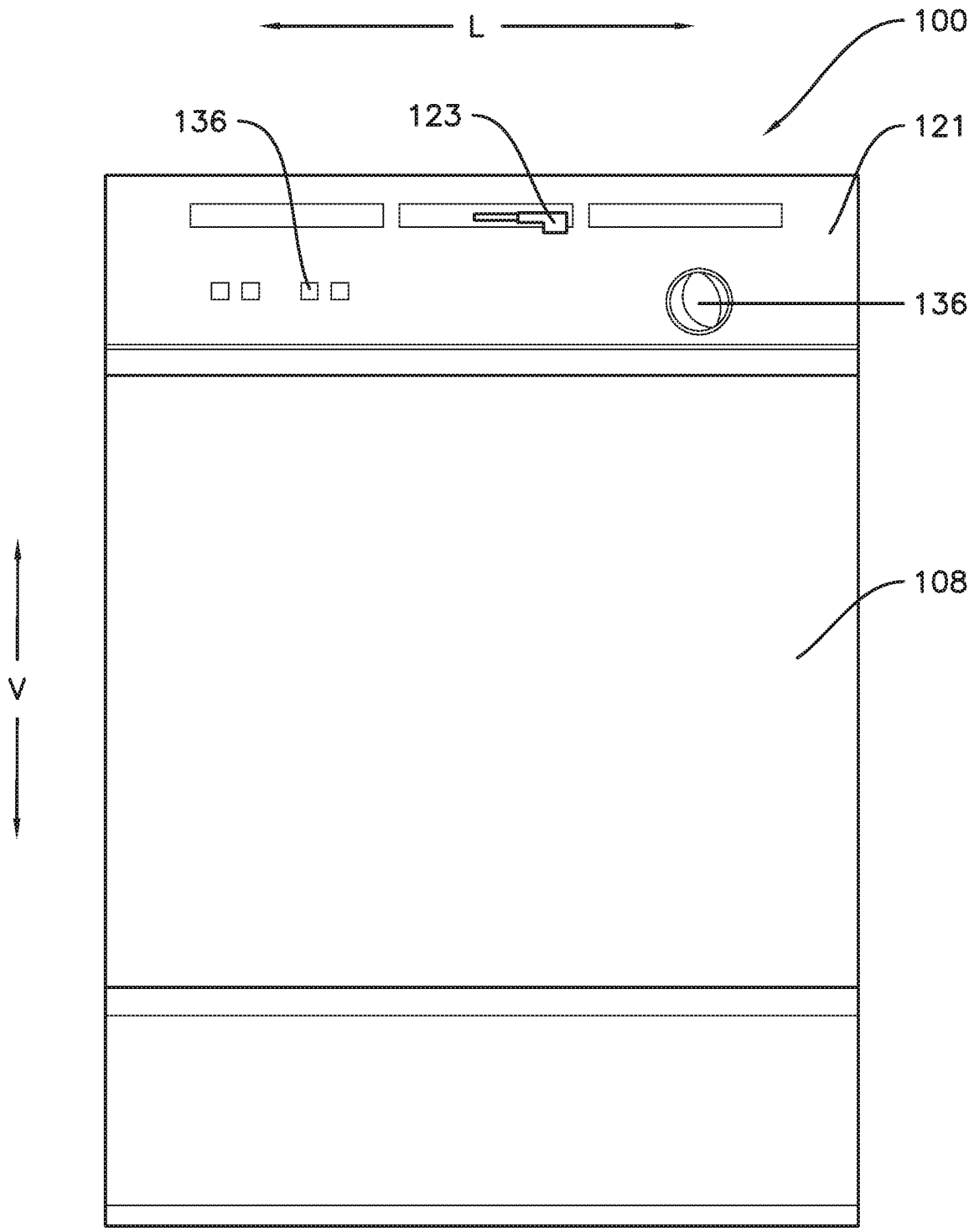
FIG. 1 illustrates a front view of one embodiment of a dishwashing appliance as may incorporate one or more embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. As used herein, terms of approximation such as "generally," "about," or "approximately" include values within ten percent greater or less than the stated value. When used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

Figure 2:
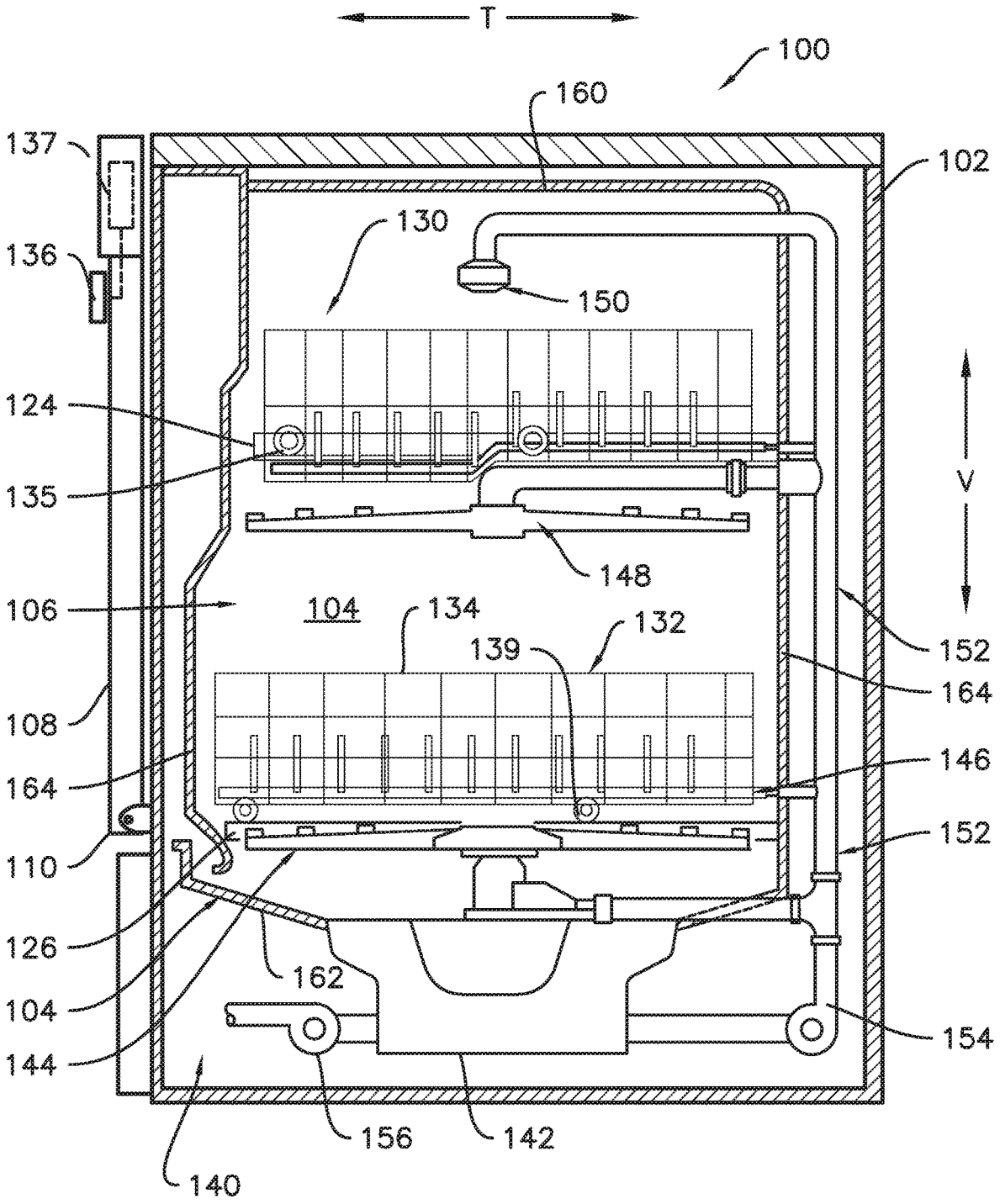
FIG. 2 illustrates a cross-sectional side view of the dishwashing appliance shown in FIG. 1, particularly illustrating various internal components of the dishwashing appliance.

Referring now to the drawings, FIGS. 1 and 2 illustrate one embodiment of a domestic dishwashing appliance 100 that may be configured in accordance with aspects of the present disclosure. As shown in FIGS. 1 and 2, the dishwashing appliance 100 may include a cabinet 102 having a tub 104 therein defining a wash chamber 106. The tub 104 may generally include a front opening (not shown) and a door 108 hinged at its bottom 110 for movement between a normally closed vertical position (shown in FIGS. 1 and 2), wherein the wash chamber 106 is sealed shut for washing operation, and a horizontal open position for loading and unloading of articles from the dishwasher. As shown in FIG. 1, a latch 123 may be used to lock and unlock the door 108 for access to the chamber 106.

As is understood, the tub 104 may generally have a rectangular cross-section defined by various wall panels or walls. For example, as shown in FIG. 2, the tub 104 may include a top wall 160 and a bottom wall 162 spaced apart from one another along a vertical direction V of the dishwashing appliance 100. Additionally, the tub 104 may include a plurality of sidewalls 164 (e.g., four sidewalls) extending between the top and bottom walls 160, 162. It should be appreciated that the tub 104 may generally be formed from any suitable material. However, in several embodiments, the tub 104 may be formed from a ferritic material, such as stainless steel, or a polymeric material.

As particularly shown in FIG. 2, upper and lower guide rails 124, 126 may be mounted on opposing side walls 164 of the tub 104 and may be configured to accommodate roller-equipped rack assemblies 130 and 132. Each of the rack assemblies 130, 132 may be fabricated into lattice structures including a plurality of elongated members 134 (for clarity of illustration, not all elongated members making up assemblies 130 and 132 are shown in FIG. 2). Additionally, each rack 130, 132 may be adapted for movement along a transverse direction T between an extended loading position (not shown) in which the rack is substantially positioned outside the wash chamber 106, and a retracted position (shown in FIGS. 1 and 2) in which the rack is located inside the wash chamber 106. This may be facilitated by rollers 135 and 139, for example, mounted onto racks 130 and 132, respectively. As is generally understood, a silverware basket (not shown) may be removably attached to rack assembly 132 for placement of silverware, utensils, and the like, that are otherwise too small to be accommodated by the racks 130, 132.

Additionally, the dishwashing appliance 100 may also include a lower spray-arm assembly 144 that is configured to be rotatably mounted within a lower region 146 of the wash chamber 106 directly above the bottom wall 162 of the tub 104 so as to rotate in relatively close proximity to the rack assembly 132. As shown in FIG. 2, a mid-level spray-arm assembly 148 may be located in an upper region of the wash chamber 106, such as by being located in close proximity to the upper rack 130. Moreover, an upper spray assembly 150 may be located above the upper rack 130.

As is generally understood, the lower and mid-level spray-arm assemblies 144, 148 and the upper spray assembly 150 may generally form part of a fluid circulation system 152 for circulating fluid (e.g., water and dishwasher fluid which may also include water, detergent, and/or other additives, and may be referred to as wash fluid) within the tub 104. As shown in FIG. 2, the fluid circulation system 152 may also include a recirculation pump 154 located in a machinery compartment 140 below the bottom wall 162 of the tub 104, as is generally recognized in the art, and one or more fluid conduits for circulating the fluid delivered from the pump 154 to and/or throughout the wash chamber 106. The tub 104 may include a sump 142 positioned at a bottom of the wash chamber 106 for receiving fluid from the wash chamber 106. The recirculation pump 154 receives fluid from sump 142 to provide a flow to fluid circulation system 152, which may include a switching valve or diverter 155 (FIGS. 3 and 4) to select flow to one or more of the lower and mid-level spray-arm assemblies 144, 148 and the upper spray assembly 150.

Moreover, each spray-arm assembly 144, 148 may include an arrangement of discharge ports or orifices for directing washing liquid onto dishes or other articles located in rack assemblies 130 and 132, which may provide a rotational force by virtue of washing fluid flowing through the discharge ports. The resultant rotation of the lower spray-arm assembly 144 provides coverage of dishes and other dishwasher contents with a washing spray.

A drain pump 156 may also be provided in the machinery compartment 140 and in fluid communication with the sump 142. The drain pump 156 may be in fluid communication with an external drain (not shown) to discharge fluid, e.g., used wash liquid, from the sump 142.

The dishwashing appliance 100 may be further equipped with a controller 137 configured to regulate operation of the dishwasher 100. The controller 137 may generally include one or more memory devices and one or more microprocessors, such as one or more general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwashing appliance 100. In the illustrated embodiment, the controller 137 is located within a control panel area 121 of the door 108, as shown in FIG. 1. In such an embodiment, input/output ("I/O") signals may be routed between the control system and various operational components of the dishwashing appliance 100 along wiring harnesses that may be routed through the bottom of the door 108. Typically, the controller 137 includes a user interface panel/controls 136 through which a user may select various operational features and modes and monitor progress of the dishwasher 100. In one embodiment, the user interface 136 may represent a general purpose I/O ("GPIO") device or functional block. Additionally, the user interface 136 may include input components, such as one or more of a variety of electrical, mechanical or electro-mechanical input devices including rotary dials, push buttons, and touch pads. The user interface 136 may also include a display component, such as a digital or analog display device designed to provide operational feedback to a user. As is generally understood, the user interface 136 may be in communication with the controller 137 via one or more signal lines or shared communication busses. It should be noted that controllers 137 as disclosed herein are capable of and may be operable to perform any methods and associated method steps as disclosed herein.

It should be appreciated that the present subject matter is not limited to any particular style, model, or configuration of dishwashing appliance. The exemplary embodiment depicted in FIGS. 1 and 2 is simply provided for illustrative purposes only. For example, different locations may be provided for the user interface 136, different configurations may be provided for the racks 130, 132, and other differences may be applied as well.

Figure 3:
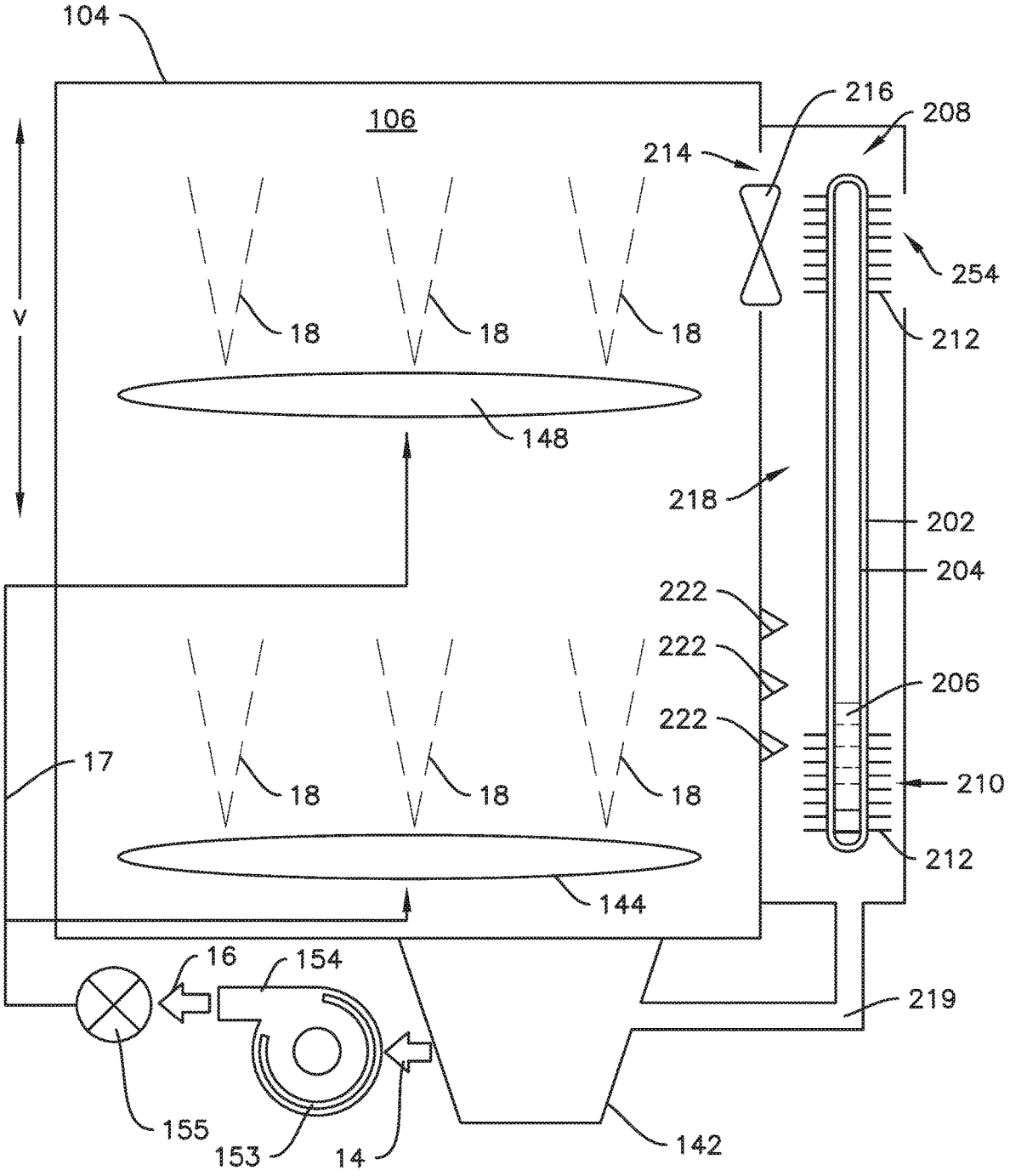
FIG. 3 provides a schematic view of a dishwashing appliance according to one or more embodiments of the present subject matter, with a fluid circulation system including a diverter valve, the diverter valve in a first position.
Figure 4:
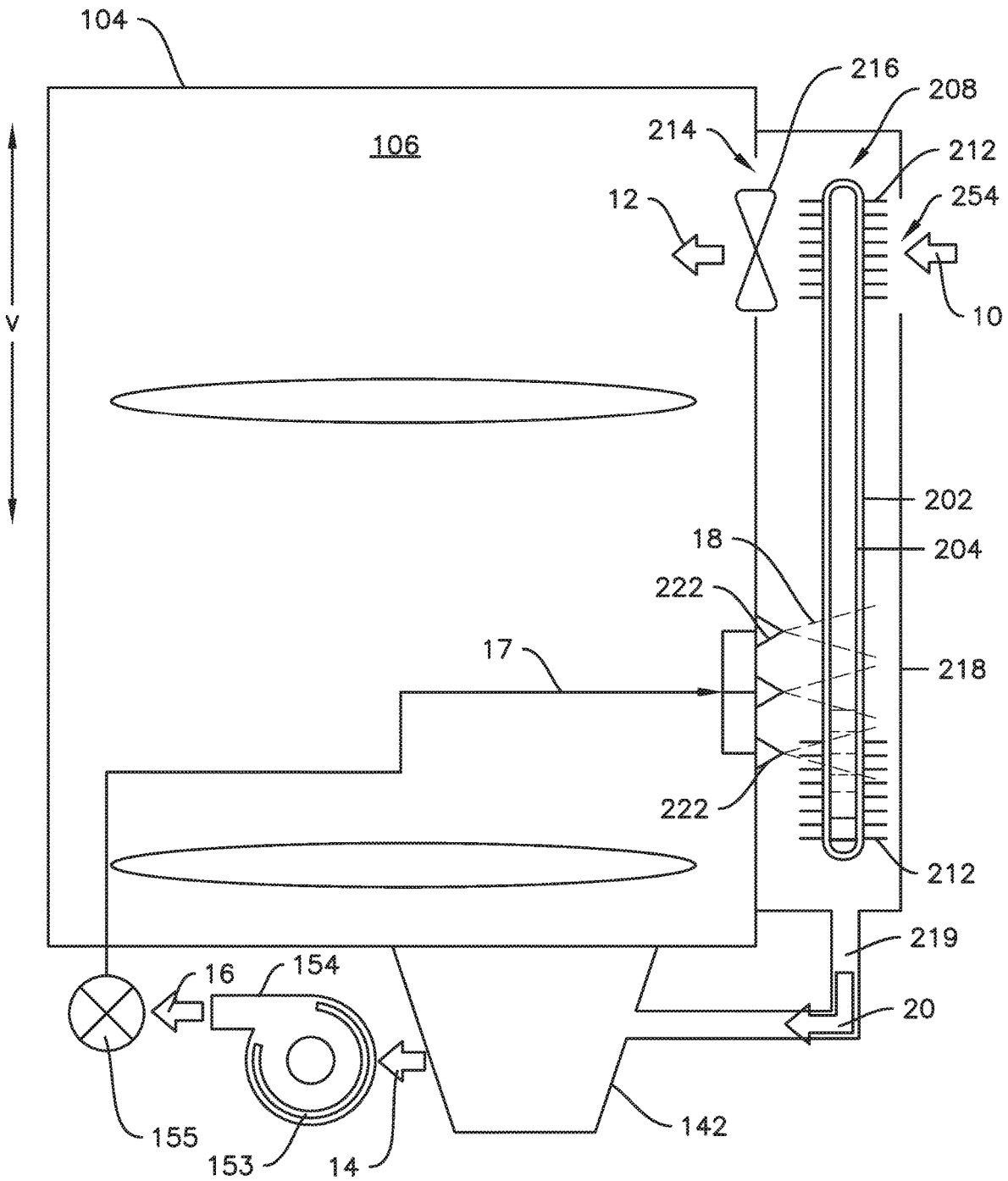
FIG. 4 provides a schematic view of the dishwashing appliance of FIG. 3 with the diverter valve in a second position.

Turning now to FIGS. 3 and 4, in at least some embodiments, a heat pipe heat exchanger 202 may be provided in order to promote drying of the wash chamber 106 and/or wet articles therein. A heat pipe heat exchanger, hereinafter referred to as a "heat pipe," is an efficient means of transferring thermal energy, e.g., heat, from one location to another. For example, in some embodiments, as illustrated in FIG. 4, the heat pipe 202, as described in more detail hereinbelow, may be configured to capture heat from liquids, e.g., a spray 18 of water and/or wash fluid, sprayed onto one end of the heat pipe 202 from a water storage chamber by one or more spray nozzles 222, and the heat pipe 202 may use the captured heat for heating an air stream on the other end. For example, in some embodiments, the heated air stream 12 may be used to dry the wash chamber 106 of dishwashing appliance 100 and wet articles, e.g., dishes, located therein. In such embodiments, the water storage chamber may be the sump 142 of the dishwashing appliance 100. In such embodiments, the heat pipe 202 may advantageously be the only heat source for the drying cycle, e.g., the dishwasher appliance 100 may not include a resistance heating element and/or may not use a resistance heating element during the drying cycle. Further, in such embodiments, the operation of the dishwashing appliance 100 may include holding liquid in the sump 142 during at least a part of the drying cycle. That is, rather than activating the drain pump 156 (FIG. 2) shortly after the wet cycle is complete and draining out the hot liquid from the sump 142, the liquid may be retained within the appliance, e.g., within the sump 142 of dishwashing appliance 100 in order to extract thermal energy from the liquid for the drying cycle, e.g., by spraying the liquid onto the heat pipe 202, before discharging the liquid from the sump 142.

The heat pipe 202 includes a sealed casing 204 containing a working fluid 206 in the casing 204. In some embodiments, the working fluid 206 may be water. In other embodiments, suitable working fluids for the heat pipe 202 include acetone, methanol, ethanol, or toluene. In other embodiments, any suitable fluid may be used for working fluid 206, e.g., that is compatible with the material of the casing 204 and is suitable for the desired operating temperature range. The heat pipe 202 extends between a condenser section 208 and an evaporator section 210. The working fluid 206 contained within the casing 204 of the heat pipe 202 absorbs thermal energy at the evaporator section 210, whereupon the working fluid 206 travels in a gaseous state from the evaporator section 210 to the condenser section 208. The gaseous working fluid 206 condenses to a liquid state and thereby releases thermal energy at the condenser section 208. A plurality of fins 212 may be provided on an exterior surface of the casing 204 at one or both of the condenser section 208 and the evaporator section 210. The fins 212 may provide an increased contact area between the heat pipe 202 and air 12 (e.g., at the condenser section 208) and/or spray 18 of wash fluid (e.g., at the evaporator section 210) flowing around the heat pipe 202 for improved transfer of thermal energy.

Figure 5:
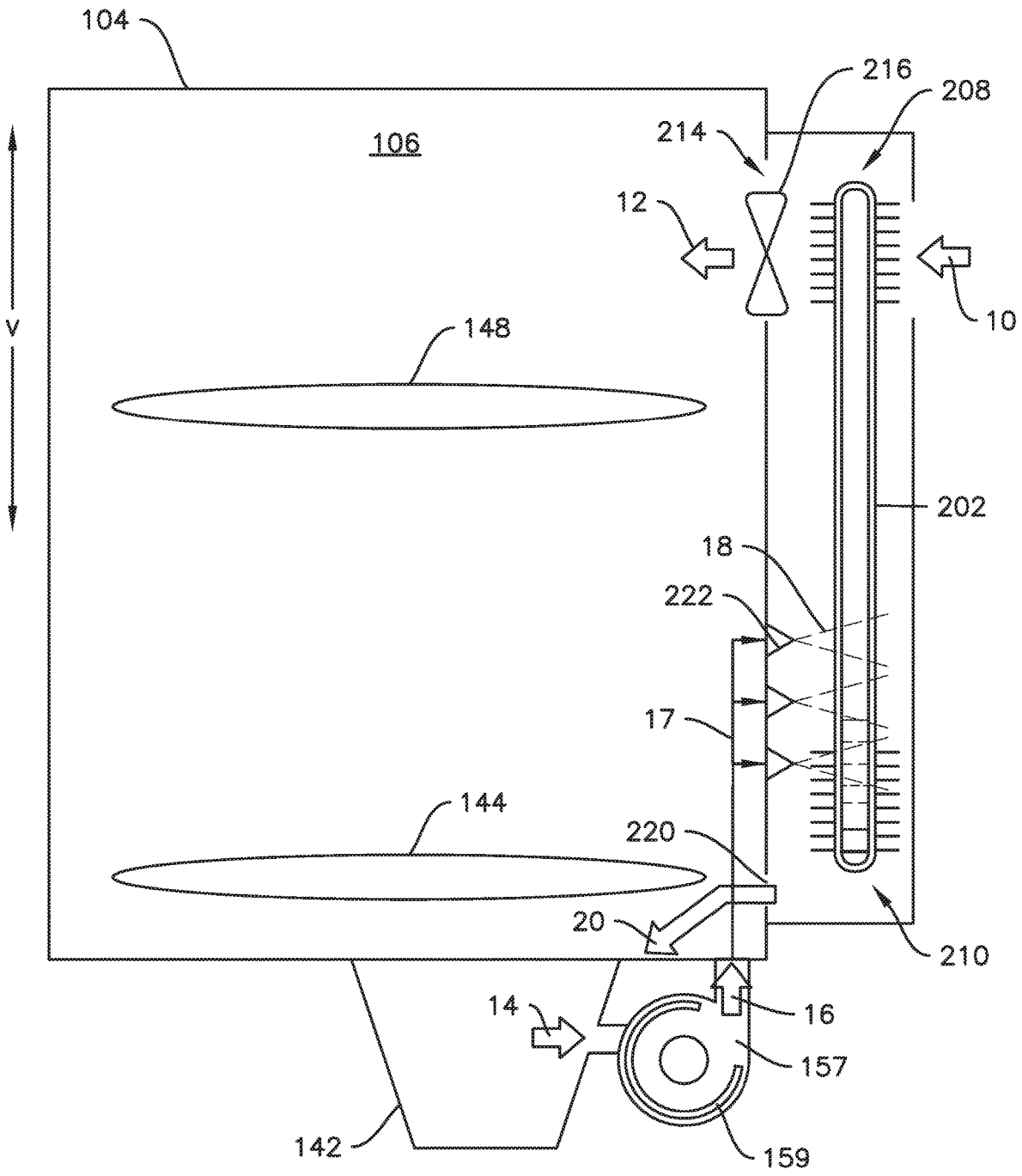
FIG. 5 provides a schematic view of a dishwashing appliance according to one or more additional embodiments of the present subject matter.

The heat pipe 202 may include an internal wick structure (not shown) to transport liquid working fluid 206 from the condenser section 208 to the evaporator section 210 by capillary flow. In some embodiments, the heat pipe 202 may be constructed and arranged such that the liquid working fluid 206 returns to the evaporator section 210 solely by gravity flow. For example, as illustrated in FIGS. 3 through 5, the heat pipe 202 may be arranged such that the condenser section 208 is positioned above the evaporator section 210 along the vertical direction V, whereby condensed working fluid 206 in a liquid state may flow from the condenser section 208 to the evaporator section 210 by gravity. In such embodiments, where the liquid working fluid 206 may return to the evaporator section 210 by gravity, the wick structure may be omitted. Such embodiments may advantageously provide a reduced cost and simpler heat pipe 202 by omitting the wick structure.

The evaporator section 210 of the heat pipe 202 may be in operative communication with the sump 142, e.g., via the fluid circulation system 152, including one or more spray nozzles 222 of the fluid circulation system 152. As shown in FIGS. 3 through 5, the evaporator section 210 of the heat pipe 202 may be in fluid communication with the fluid circulation system 152. For example, the fluid circulation system 152 may include one or more spray nozzles 222 configured to spray wash fluid onto the evaporator section 210 of the heat pipe 202. The heat pipe 202 may also be in fluid communication with an ambient environment externally around the dishwashing appliance 100, such as the ambient environment around, e.g., in close proximity to, an exterior of the dishwashing appliance 100, such as the immediate surroundings of the dishwashing appliance 100 from which air may be drawn directly into an intake 254. As illustrated, e.g., in FIGS. 3 through 5, the tub 104 may include an inlet 214 defined in the tub 104. The inlet 214 may provide fluid communication into the wash chamber 106 of the dishwashing appliance 100. The inlet 214 may be in direct fluid communication with the wash chamber 106, and the condenser section 208 of the heat pipe 202 may be positioned proximate to the inlet 214, e.g., immediately adjacent to the inlet 214. The dishwashing appliance 100 may also include a fan 216 configured to urge hot air 12 through the inlet 214. For example, in some embodiments, the fan 216 may be configured to urge ambient air 10 from the ambient environment through the inlet 214, e.g., as illustrated in FIGS. 4 and 5. In various embodiments, the condenser section 208 of the heat pipe 202 may be in operative communication with the inlet 214 upstream of the wash chamber 106. For example, as illustrated, the condenser section 208 may be positioned at or proximate to the inlet 214. For example, the condenser section 208 of the heat pipe 202 may be positioned between the intake 254 and the wash chamber 106, e.g., downstream of the intake 254 and upstream of inlet 214 into the tub 104.

As shown, the ambient air 10 may be drawn into the dishwashing appliance 100 via the intake 254, e.g., the ambient air 10 may be urged from the ambient environment through the intake 254 by the fan 216, and from the intake 254 into the wash chamber 106 via the inlet 214, where the air passes over and around the condenser section 208 of the heat pipe 202 while travelling between the intake 254 and the inlet 214, including over and around fins 212 on the heat pipe 202 in some embodiments, such that the air receives thermal energy from gaseous working fluid 206 which condenses in the condenser section 208 of the heat pipe 202, to create a flow of hot dry air 12.

The flow of hot dry air 12 may travel through the wash chamber 106 to promote drying of dishes or other articles, e.g., located in rack assemblies 130 and 132 within the wash chamber 106, whereupon the hot dry air 12 imparts thermal energy to and receives moisture from the articles and/or the wash chamber 106. As used herein, "hot air" includes air having a temperature of at least about 90° F., such as at least about 100° F., such as between about 100° F. and about 160° F., such as between about 115° F. and about 155° F., such as about 135° F. As noted above, terms of approximation, such as "generally," or "about" are used herein throughout to include values within ten percent greater or less than the stated value. For example, "about 135° F." includes from 121.5° F. to 148.5° F. As used herein, "dry air" includes air having a relative humidity less than about twenty percent, such as less than about fifteen percent, such as less than about ten percent, such as less than about five percent, such as about zero.

Where the evaporator section 210 of the heat pipe 202 is in operative communication with the sump 142, e.g., via spray nozzles 222, the temperature of the hot dry air 12 will be approximately the same as the temperature of the liquid in the sump 142, depending at least in part on the efficiency of the heat pipe 202. For example, the temperature of the wash liquid stored in the sump 142 may be about 150° F. to about 160° F. In such embodiments, depending on the dimensions of the heat pipe 202, e.g., the length and diameter of the heat pipe 202, and the type of working fluid 206, the hot air 12 may be anywhere within the temperature ranges set forth above, but will generally be less than the temperature of the liquid in the water storage chamber, e.g., sump 142.

One of skill in the art will recognize that the heat pipe 202 may be activated when one or both of the spray nozzles 222 and the fan 216 operates. For example, liquid working fluid 206 may be stored in the evaporator section 210 until the spray nozzles 222 operate to provide the spray 18 (FIGS. 4 and 5) to the evaporator section 210, whereupon thermal energy from the spray 18 may be transferred to the working fluid 206, causing the working fluid 206 to evaporate and travel to the condenser section 208. Further, when the fan 216 operates, e.g., when the fan 216 urges ambient air 10 about the condenser section 208, thermal energy may then be transferred from the evaporated working fluid 206 at the condenser section 208 to the air 10. As the working fluid 206 in the condenser section 208 becomes relatively cool, the working fluid 206 will condense and flow in liquid form to the evaporator section 210, e.g., by gravity and/or capillary flow.

As shown in FIGS. 3 and 4, in some embodiments, the fluid circulation system 152 may further include a diverter valve 155 downstream of the recirculation pump 154. As will be understood, the recirculation pump 154 may be downstream of the water storage chamber, e.g., sump 142, in that that the pump 154 receives wash fluid 14 from the sump 142, e.g., the recirculation pump 154 may be connected to the sump 142 at an intake of the recirculation pump 154 such that, when activated, the recirculation pump 154 pumps liquid 14 from the sump 142. Similarly, the diverter valve 155 may be downstream of the recirculation pump 142 in that the diverter valve 155 may be connected to an outlet of the recirculation pump 154 to receive a flow of liquid 16 from the recirculation pump 154, either directly or via one or more conduits, etc. In such embodiments, the diverter valve 155 may be selectively positionable in a plurality of positions to direct liquid 17 to one or more additional components of the fluid circulation system 152, such as one or more of the spray arms 144, 148, etc., or the spray nozzles 222. For example, the plurality of positions of the diverter valve 155 may include at least a first position and a second position. When the diverter valve 155 is in the first position, liquid 17 may be delivered to at least one spray assembly positioned within the wash chamber 106, e.g., at least one of the lower and mid-level spray-arm assemblies 144, 148 and the upper spray assembly 150. When the diverter valve 155 is in the second position, liquid 17 may be delivered to the spray nozzles 222 in fluid communication with the evaporator section 210 of the heat pipe 202. As shown in FIGS. 3 and 4, the liquid 14 from the sump 142 may be delivered from the recirculation pump 154 as a pressurized flow 16 to the diverter valve 155. As shown in FIG. 3, when the diverter valve 155 is in the first position, the diverter valve 155 may provide liquid 17 to one or more spray arms 144 and/or 148 such that the spray 18 of wash fluid emanates from one or both spray arms 144 and/or 148. As shown in FIG. 4, when the diverter valve 155 is in the second position, the diverter valve 155 may direct the liquid 17 to the spray nozzles 222, such that the spray 18 emanates from the spray nozzles 222 and onto the evaporator section 210 of the heat pipe 202.

Also shown in FIGS. 3 and 4, the recirculation pump 154 may include an inline heating element 153 (sometimes also referred to as an "inline heater") in operative communication with the pump 154, e.g., the inline heating element 153 may be provided as a resistance heating element such as a heating rod which is integrated with and at least partially encircles the pump 154. The inline heating element 153 may be activated to heat wash fluid flowing through the recirculation pump 154, e.g., during the wet cycle, as shown in FIG. 3. In some embodiments, the wash fluid may be heated again by the inline heating element 153 during the dry cycle, e.g., when the wash fluid is flowed from the sump 142 to the spray nozzles 222, as shown in FIG. 4. In other embodiments, the residual heat remaining in the wash fluid after the wash fluid returns to the sump 142 from the wash chamber 106 in the wet cycle may be sufficient to activate the heat pipe 202, consequently, some embodiments may not include activating the inline heating element 153 during the dry cycle.

As shown in FIG. 5, in some embodiments, the fluid circulation system 152 may include an additional pump 157 which is dedicated to the heat pipe 202. In such embodiments, the dedicated pump 157 may be configured to pump wash fluid directly from the dedicated pump 157 to the one or more spray nozzles 222, e.g., without an intervening structure such as the diverter valve 155. In some embodiments, the dedicated pump 157 may also include an inline heating element 159, similar to the inline heating element 153 described above.

As shown in FIGS. 3 through 5, the heat pipe 202 may be disposed in a side chamber 218 of the tub 104. The side chamber 218 may be in fluid communication with the sump 142 by gravity. For example, as shown in FIGS. 4 and 5, the spray 18 may collect on and drip off of the evaporator section 210, forming a stream of runoff 20, and the side chamber 218 may be positioned above the sump 142 along the vertical direction V, such that the runoff 20 from the side chamber 218 flows by gravity to the sump 142. As shown in FIGS. 3 and 4, in some embodiments, the dishwashing appliance 100 may include a return conduit 219 extending from the side chamber 218 to the sump 142 and external to the tub 104. In such embodiments, the runoff 20 may flow from the side chamber 218 by gravity via the return conduit 219 to the sump 142. As shown in FIG. 5, in some embodiments, the side chamber 218 may include an outlet 220 at or near a bottom of the side chamber 218, and the outlet 220 may be in fluid communication with the wash chamber 106. In such embodiments, the runoff 20 may flow from the side chamber 218 by gravity via the outlet 220 through the wash chamber 106 and back to the sump 142.

Figure 6:
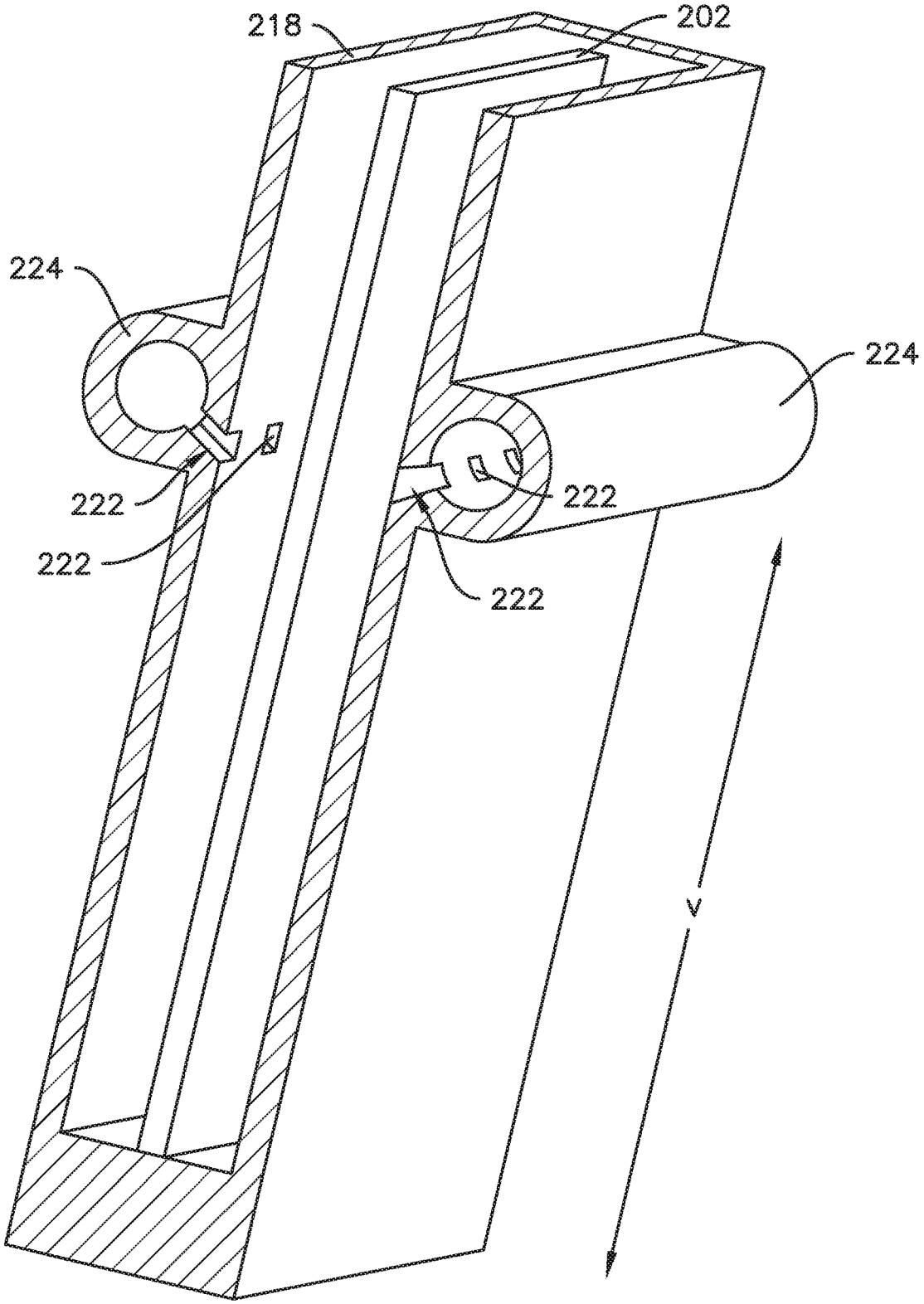
FIG. 6 provides a sectional perspective view of a heat pipe heat exchanger and spray nozzles according to one or more embodiments of the present subject matter.
Figure 7:
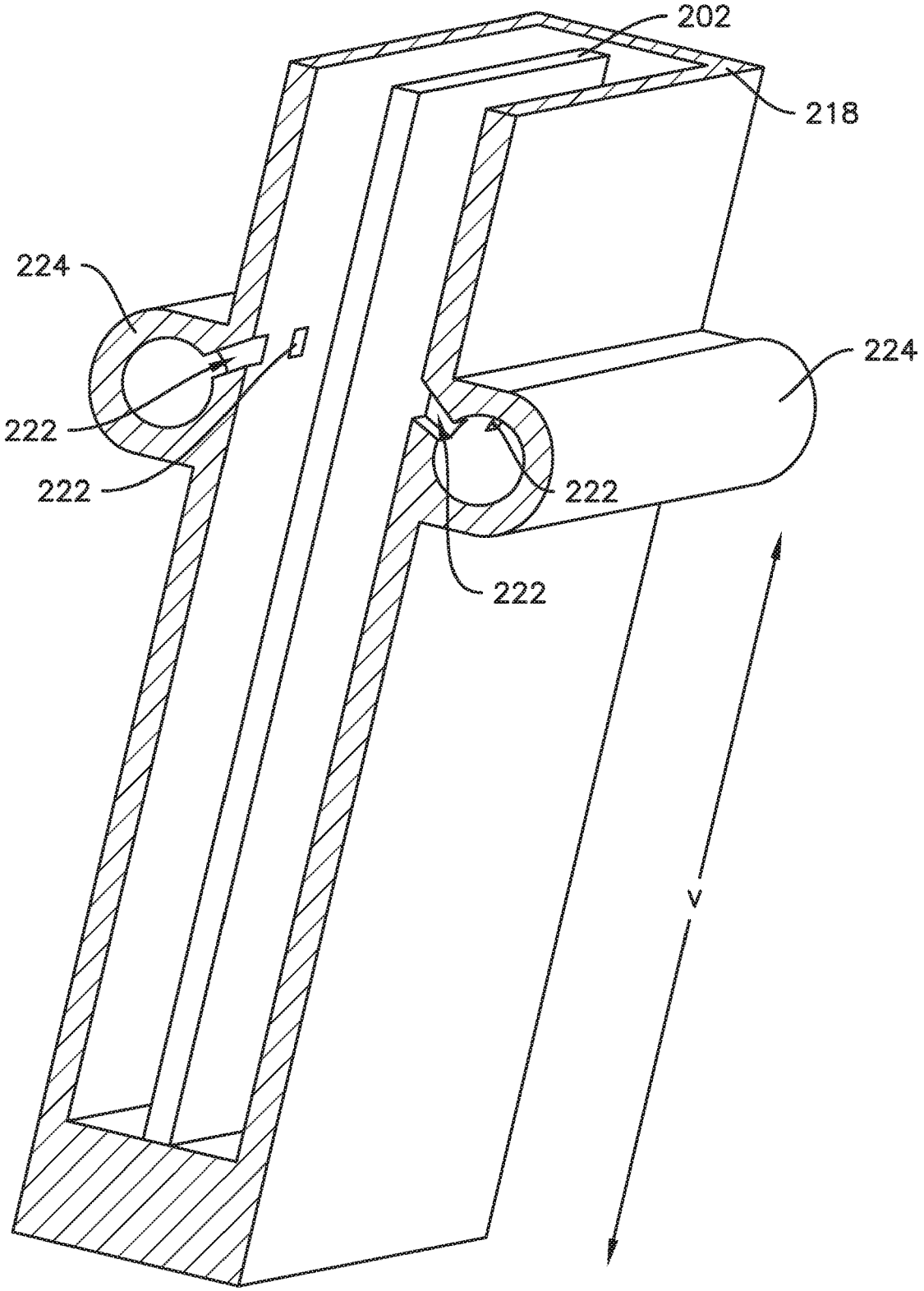
FIG. 7 provides a sectional perspective view of a heat pipe heat exchanger and spray nozzles according to one or more additional embodiments of the present subject matter.

Sectional perspective views of a portion of the side chamber 218 according to various embodiments of the present disclosure are illustrated in FIGS. 6 and 7. As shown in FIGS. 6 and 7, the spray nozzles 222 may include at least one spray nozzle 222 positioned on each of two opposing sides of the heat pipe 202. For example, the one or more spray nozzles 222 may include a first spray nozzle 222 on a first side of the heat pipe 202 and a second spray nozzle 222 on a second side of the heat pipe, where the second side is opposite of the first side. In such embodiments, the first and second spray nozzles 222 may direct the spray 18 (e.g., FIGS. 4 and 5) towards one another.

In some embodiments, the heat pipe 202 may be generally flat, e.g., rectangular, as illustrated in FIGS. 6 and 7, with the longer sides of the rectangular heat pipe 202 oriented towards the spray nozzles 222 to provide a larger surface area to receive the spray 18, e.g., as compared to the smaller sides of the rectangular heat pipe 202, to maximize the proportion of the heat pipe 202 exposed to the spray 18. Although only a single heat pipe 202 is shown, in some embodiments, multiple heat pipes 202 may be provided, e.g., in a staggered manner such that each heat pipe 202 receives at least a portion of the spray 18 from the spray nozzles 222.

Still referring to FIGS. 6 and 7, the spray nozzles 222 may be provided as apertures 222 formed in one or more pressure conduits 224, where the pressure conduits 224 receive the pressurized flow 16 from the recirculation pump 154 (FIG. 4) or the dedicated pump 157 (FIG. 5). The pressure conduits 224 may be positioned on or outside of the side chamber 218. For example, the pressure conduits 224 may be integrally formed with the side chamber 218, as shown in FIGS. 6 and 7. The spray nozzles 222 may be oriented to direct the spray 18 downward along the vertical direction V, e.g., as illustrated in FIG. 6, or upward along the vertical direction V, e.g., as illustrated in FIG. 7. In further embodiments, the spray nozzles 222 may be oriented to direct the spray 18 generally perpendicular to the vertical direction V, e.g., as illustrated in FIGS. 4 and 5.

Figure 8:
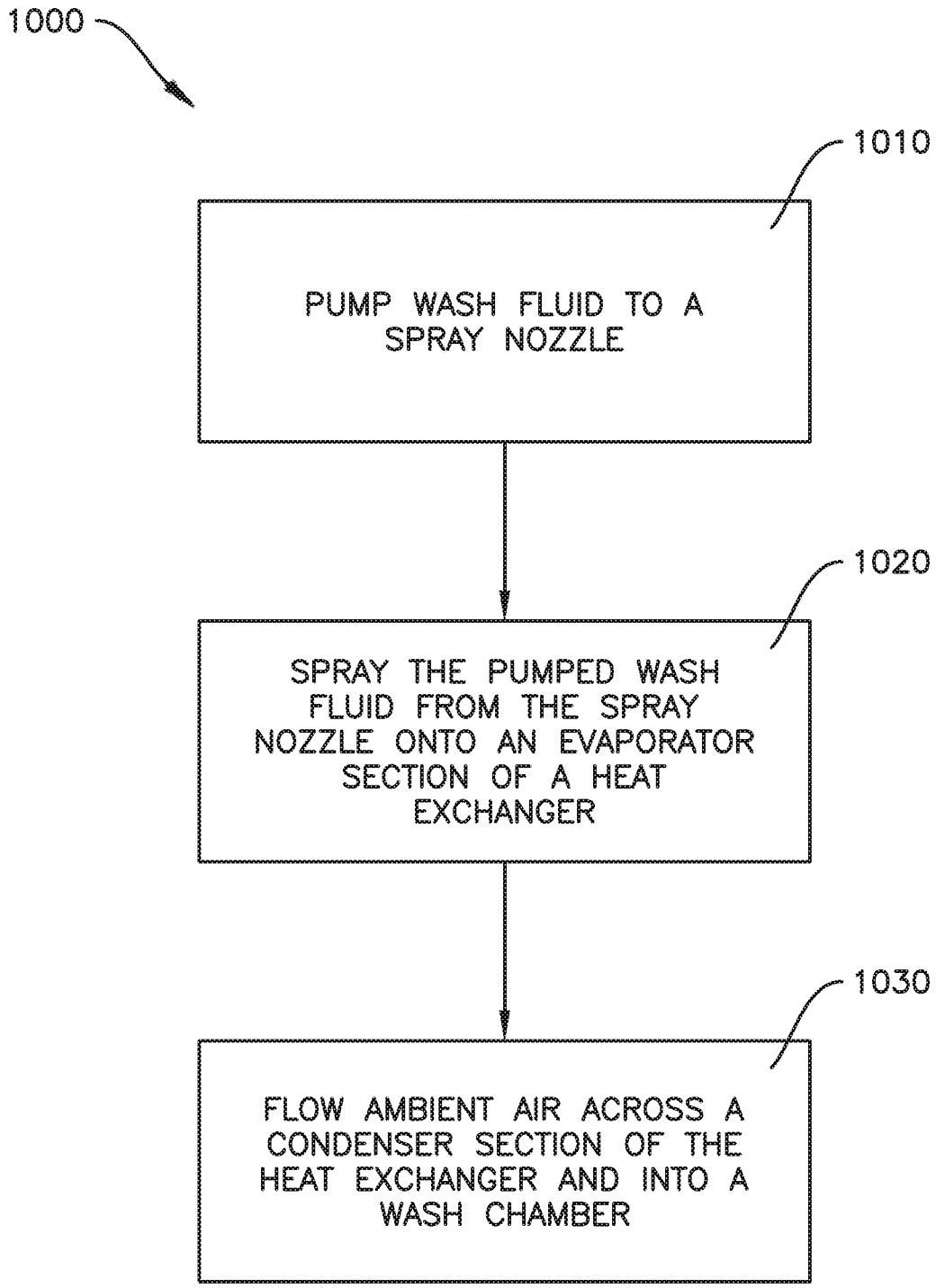
FIG. 8 provides a flow chart of an exemplary method of operating a dishwashing appliance according to one or more embodiments of the present subject matter.

Turning now to FIG. 8, embodiments of the present subject matter also include methods of operating a dishwashing appliance, such as the example method 1000 illustrated in FIG. 8. As noted above, such methods may at least in part be embodied as instructions stored in memory and executed by the controller 137. The method 1000 may include a step 1010 of pumping wash fluid, e.g., wash fluid 17, from a storage chamber, e.g., sump 142, of the dishwashing appliance to a spray nozzle, e.g., one of the one or more spray nozzles 222. The method 1000 may further include a step 1020 of spraying the pumped wash fluid from the spray nozzle onto an evaporator section of a heat pipe heat exchanger, e.g., the evaporator section 210 of one or more of the exemplary heat pipes 202 shown in FIGS. 3 through 7 and described above. The method 1000 may also include a step 1030 of flowing ambient air 10 across a condenser section of the heat pipe heat exchanger to form a flow of hot, dry air 12 into a wash chamber of the dishwashing appliance from the condenser section of the heat pipe heat exchanger.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a dishwashing appliance, comprising:

pumping wash fluid from a storage chamber of the dishwashing appliance to a spray nozzle;

spraying the pumped wash fluid from the spray nozzle onto an evaporator section of a heat pipe heat exchanger; and flowing ambient air across a condenser section of the heat pipe heat exchanger to form a flow of hot, dry air into a wash chamber of the dishwashing appliance from the condenser section of the heat pipe heat exchanger.

2. The method of claim 1, further comprising positioning a diverter valve to direct water to the spray nozzle prior to pumping the wash fluid from the storage chamber.

3. The method of claim 1, further comprising flowing a return flow of the wash fluid from the evaporator section of the heat pipe heat exchanger to the storage chamber by gravity via a return conduit external to a tub of the dishwashing appliance.

4. The method of claim 1, further comprising flowing a return flow of the wash fluid from the evaporator section of the heat pipe heat exchanger to the storage chamber by gravity via the wash chamber.

5. The method of claim 1, wherein spraying the pumped wash fluid comprises spraying the pumped wash fluid from the spray nozzle onto a second plurality of fins of the evaporator section of the heat pipe heat exchanger, and wherein flowing ambient air comprises flowing ambient air across a first plurality of fins of the condenser section of the heat pipe heat exchanger and into the wash chamber.

6. The method of claim 1, further comprising circulating the wash fluid through the wash chamber of the dishwashing appliance wherein the storage chamber comprises a sump positioned at a bottom of the wash chamber.

7. The method of claim 1, wherein flowing the ambient air comprises activating a fan to urge the ambient air through an inlet into the wash chamber.

* * * * *